United States Patent [19]

Aurich et al.

[11] 4,372,548

[45] Feb. 8, 1983

[54] DEVICE FOR SEPARATING FLEXIBLE PLANAR MATERIAL

[75] Inventors: Horst Aurich, Karl-Marx-Stadt; Brigitta Bochmann, Lössnitz; Klaus Grosse, Berlin; Eberhard Köhler; Michael Nestler, both of Karl-Marx-Stadt; Hans-Christian Ochsenfarth, Mühlhausen; Gerhard Seyfarth, Karl-Marx-Stadt, all of German Democratic Rep.

[73] Assignee: VEB Kombinat Textima, Karl-Marx-Stadt, German Democratic Rep.

[21] Appl. No.: 241,887

[22] Filed: Mar. 9, 1981

[30] Foreign Application Priority Data

Mar. 28, 1980 [DD] German Democratic Rep. ... 220013

[51] Int. Cl.[3] ..... B65H 3/22

[52] U.S. Cl. ..... 271/18.3

[58] Field of Search ..... 271/18.3

[56] References Cited

U.S. PATENT DOCUMENTS

| | | | |
|---|---|---|---|
| 3,176,979 | 4/1965 | Engelmann | 271/18.3 |
| 3,902,750 | 9/1975 | Roitel | 271/18.3 X |
| 3,981,495 | 9/1976 | Bijttebier | 271/18.3 |

*Primary Examiner*—Richard A. Schacher

*Attorney, Agent, or Firm*—Jordan and Hamburg

[57] ABSTRACT

The present invention is directed to a device for separating a stack of flexible, planar material such as cloth, comprising a fixed set of pins and an adjustable set of pins, where the adjustable set of pins follows a downwardly curved path of motion to create a fold in the top layer of the stack of , so that this layer may be conveniently lifted off without lower layers adhering to the top layer.

5 Claims, 4 Drawing Figures

DEVICE FOR SEPARATING FLEXIBLE PLANAR MATERIAL

BACKGROUND OF THE INVENTION AND PRIOR ART STATEMENT

The invention relates to a device for separating flexible planar material, particularly separating blanks from a staple for clothing parts.

The use of the aerodynamical paradox for separating is known, as for instance in DD-PS No. 72,208, where the prevailing suction is used for lifting the top layer off a staple. The prevailing suction is greatly dependent on the material. Furthermore, the danger exists that one or more of the consecutively cut parts may adhere, so that the needed uniformity of operation cannot be guaranteed. Other devices use adherent carriers as for instance DE-OS No. 1,760,616, a method which is not capable of preventing the adherence of additional blanks. Additionally, smudging of adhering surfaces, needed for only a short time, makes repeated cleansing necessary.

Furthermore, it has been known to use operational elements for separating which are furnished with pins, hooks or card filleting. When card filleting is used as in DD-PS No. 104,272 and SU-PS 603,626, two operational elements, each furnished with outwardly pointing card filleting, are positioned upon the top cut part and then spread, whereby the layer of material may be stretched, gripped and lifted off. U.S. Pat. No. 2,160,437 illustrates an analogous principle where the two operational elements denote a rake shaped form with outwardly bent prongs.

A similar principle of solution is found in DD-PS No. 116,192, DE-OS No. 2,002,750, DE-OS No. 2,407,941 and DE-OS No. 2,611,739, where pinshaped parts prick into the edges of the top blank while rotating in an outwardly direction, or where these elements puncture the top piece with an arcuate pin again towards the respective surface, a method which is supposedly aimed at stretching the part to be separated.

All these solutions, though, do not make certain that consecutive layers will not adhere to the piece to be separated. Therefore DE-OS No. 2,160,437 even mentions an additionally-needed auxiliary for separation. Furthermore, the arcuate puncturing can be used only for comparatively thicker material, to prevent the danger that consecutive pieces might be punctured and lifted along too.

DE-OS No. 2,839,257 discloses that the top piece is pricked by vertical pins and thereafter lifted, which permits the same aforementioned disadvantages of decreased reliability of operation.

According to DD-PS No. 123,732 pins are disposed in a circle and point outwardly. These pins prick into the piece to be separated while the plane of material lying within the pins is subjected to tension. This causes the pins to penetrate deeper into that portion of the blank which is stretched, and the process of separation occurs by lifting thereafter. Due to the fact that only a narrowly limited portion of the top piece is acted upon, the danger also exists here that consecutive pieces might adhere. This may happen despite the complicated structure of this device.

Finally, a method is known where pieces to be separated are gripped along points on their surface. Thus, according to DD-PS No. 108,708 two pins are fastened to a thrust-toggle and cause formation of a fold in the material. This fold is clamped by a consecutive cross-over of the pins, while the pin points outline a coupler curve ending almost horizontally.

The suggestion of an additionally needed impulse of compressed air here also shows that this device is not entirely dependable when separation is expected.

Contrary to the aforementioned device, the device of DE-OS No. 2,401,737 grips with two gripping jaws, with one ending in a triangular point and the other provided with a v-shaped recess fitting onto the first one.

All these known technical solutions are not capable of performing a reliable separation from a staple without the need for additional means to separate additional pieces adhering due to adherent properties. These means require additional expenses and frequently damage to the staple or the shape and position of the separated piece is contemplated.

The objective of the invention is to perform the separation process in such a manner that reliable separation of individual top blanks of a staple occurs without additional means, neither shape nor position being impaired in order to make an automatic process possible and, additional automatic processing of the separated individually severed blanks, if necessary.

SUMMARY OF THE INVENTION

The invention is based upon the task to attain the objective, by causing movement over the whole surface of the piece to be separated relative to the piece lying underneath by means of an appropriate, technically uncomplicated device for overcoming the adherent forces, and by planarly lifting the top piece thereafter.

This is obtained according to the invention by a device where a connecting element is situated under a vertical lifting element, said connecting element articulated and capable of being extended by a driving element in a longitudinal direction. This connecting element may consist of one or more segments. Each of its lateral ends is firmly connected to an immobile transversal pin carrier, with these pin carriers supporting downwardly pointing pins arranged at intervals from each other. The pin carriers also have at least two guiding elements at greater distances, each of which is connected to a mobile pin carrier by a drive element, said latter pin carrier being provided with downwardly pointing pins also arranged at intervals along its whole length. These pins form an acute angle with each adjacent pin of the immobile pin carrier, while each of the mobile pin carriers has at least two longitudinal holes formed with convex curved grooves, serving to mesh with the guiding elements of the immobile pin carrier. Furthermore, the individual immobile pin carriers are each provided with one pressure plate by means of spacer pieces underneath both pin bars consisting of immobile and mobile pin carriers. The pressure plate is provided with slots into which the pins of the immobile pin carrier protrude and also slightly penetrate. The order of pins is preferably chosen here, so that the pins of the mobile pin carrier are bent slightly more angularly than the pins of the immobile pin carrier.

It is satisfactory that the pins of each pin bar are arranged in the same vertical plane which corresponds to the longitudinal direction of the pin carrier. However, they may also be additionally bent in a lateral direction. Here the pinpoints are only congruent in the longitudinal direction.

For separation, the device is lowered by the lifting element onto the staple, causing the pins of the immobile pin carrier to touch the surface of the piece to be separated, thereby setting it in position. Actuation of the drive elements moves and lowers the mobile pin carriers due to guidance by the longitudinal holes. They reach their lowest position in the vertex of the convex curved groove and there form a fold in the material. Continuing this motion, the pins of the mobile pin carrier again rise while moving closer to the pin points of the immobile pin carrier and reinforcing the creation of the fold.

By actuating the lifting element as well as the driving element of the articulated connecting element, the separating device is lifted and the raised piece is stretched in cross direction by both bars moving apart. The raised piece is thereby gripped securely and levelly raised. Adherent forces which might be occassionally present are completely overpowered by the cross tension.

Renewed actuation and reverse motion of the drive elements of the mobile pin carriers causes the mobile pin carriers to be guided into their starting position and thereby allows the separated piece to be planarly deposited upon a connected processing location.

The stability of the separating effect is based upon generating motion extending over the whole piece relative to the piece that is disposed underneath. The reason is that formation of folds occurs by locally alternating bunching (within the fold areas) and stretching (in the areas of the materials lying between the folds) and that in these two longitudinal areas, relative motion occurs at each point. These bunching and stretching effects are caused by the motion of the mobile pin carriers while the material is secured in position by the pins of the immobile pin carrier. Due to the fact that previously known separating devices usually only gripped the outer area of the pieces to be separated and thereby exerted only a stretching effect of the whole layer but were not able to obtain that effect in the central area because material is usually inflexible, no motion relative to the next layer of the staple occurred despite all the stretching. This caused existing adherent forces to remain, made adherence of the succeeding piece inevitable and created a hazardous automatic manufacturing track. The practical and simple construction of the device according to the invention allows for arrangement of pin pairs in compact succession upon each pair of pins carriers, an arrangement that allows for relative motion even for materials with very small inherent elasticity. Adherent force, still occassionally possible in the central area, is neutralized by consecutive tightening of the piece in cross direction.

When separating large planar pieces, it is practical to arrange two connecting elements in order to improve stability. Furthermore, an additional third pin bar may be arranged which is preferably disposed, for instance, underneath the lifting element and which is arranged in the middle of the connecting elements. By this arrangement, relative motion is guaranteed even in the central area of large planar pieces.

In this embodiment of the device according to the invention, the position of this middle pin bar remains unchanged when the connecting elements move while the two lateral pin bars move away from this pin bar, thereby causing tightening of the piece between the middle and the lateral pin bars.

For very small cut parts, it is also possible to provide the separation device with only one pin bar which would be arranged directly under the lifting element.

BRIEF DESCRIPTION OF THE DRAWINGS

The invention is explained herebelow in detail according to an embodiment. The pertinent drawings illustrate the device according to the invention in which

For improved visualization, FIG. 3 illustrates the driving element for the right pin bar only.

DETAILED DESCRIPTION OF A PREFERRED EMBODIMENT

Figure 1:
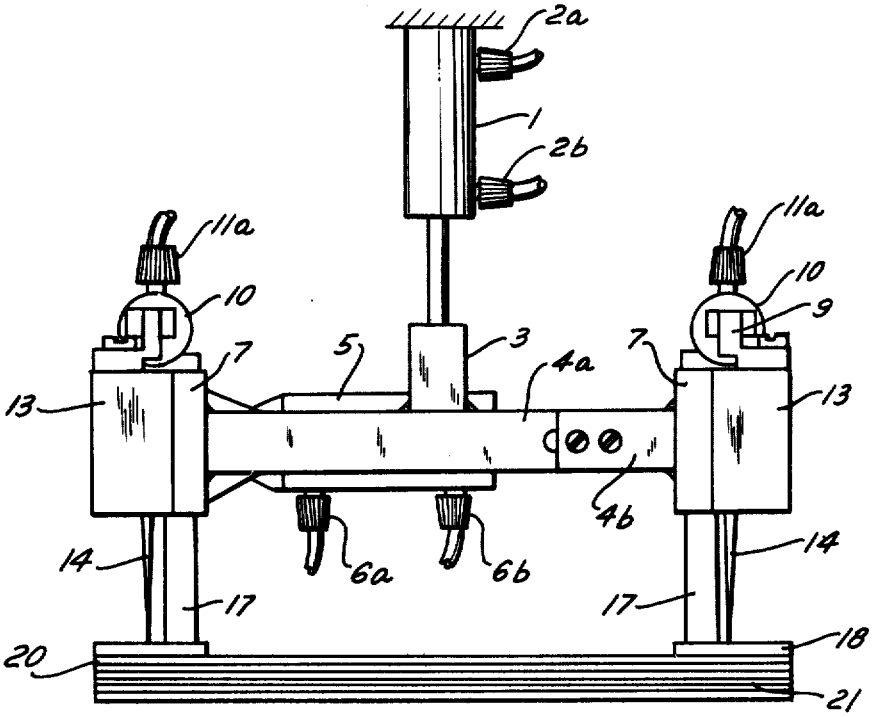
FIG. 1 is a frontal elevational view in operating position.
Figure 2:
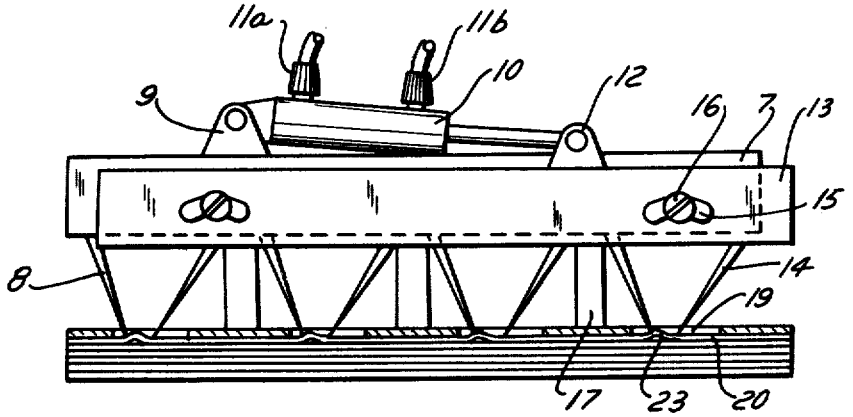
FIG. 2 is a side elevational view of a pin bar in intermediate operating position.
Figure 3:
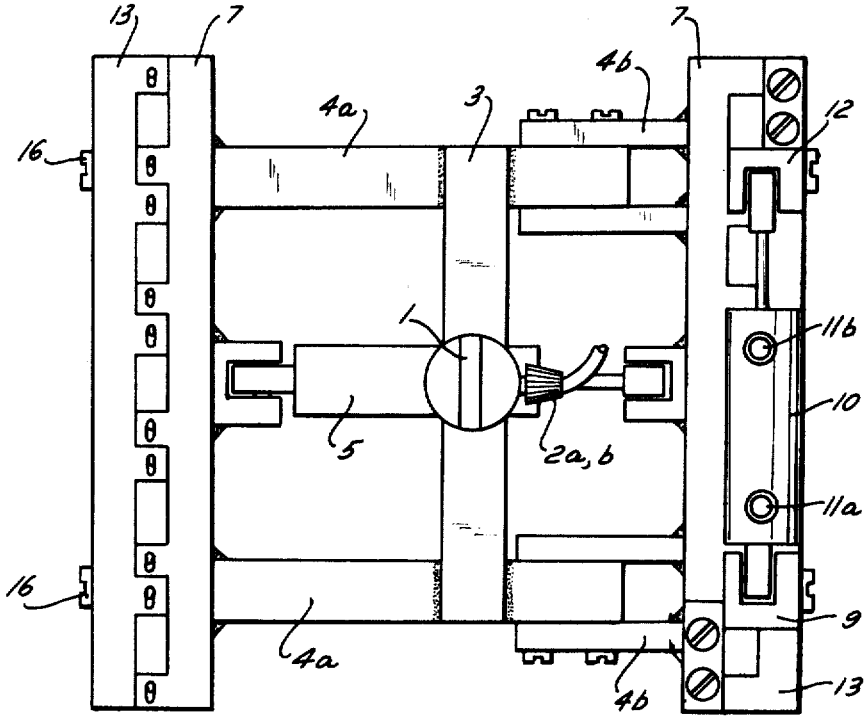
FIG. 3 is a top view in operating position.

A lifting element 1 consisting of a pneumatic cylinder is attached to air linkages 2*a*, 2*b* and vertically by a bridge 3 to a two-membered, horizontally disposed connecting element 4. This connecting element 4 consists of segments 4*a* and 4*b*, which are capable of moving relative to each other so that the connecting element 4 may be elongated (operating position) and may again be shortened (starting position). These movements are actuated by a driving element 5 which is a pneumatic cylinder provided with air linkages 6*a*, 6*b*. Each of the connecting segments 4*a* and 4*b* is firmly connected laterally to an inner immobile pin carrier 7 of a pin bar, said carrier provided with pins arranged along its length. One form piece 9 is fastened to each inner immobile carrier 7. A driving element 10 consisting of a pneumatic cylinder with air linkages 11*a*, 11*b* is adjustably supported and is adjustably connected laterally by each form piece 12 to mobile outer pin carriers 13 having pins 14 distributed along their length. Here pins 8, 14 are fastened to the pin carriers 7, 13 in such a manner that their points face towards each other. In this embodiment, pins 14 are preferably more sharply bent than pins 8 and both types of pins in this embodiment are preferably disposed in an identical, vertically extending plane.

Each of the outer, mobile pin carriers 13 additionally possess two longitudinal holes 15 having the shape of curved grooves. Each of the longitudinal holes 15 meshes with a guiding element 16, which is a dowel screw and is fastened to the inner pin carrier 7. Furthermore, spacer pieces 17 are detachably fastened. The spacer pieces 17 extend in a vertical plane and support at their opposite end a horizontal pressure plate 18 having slots 19 into which pins 8 and 14 are capable of extending. The detachable connection of the spacer pieces 17 allows elevational displacement of pressure plate 18, in order to accommodate the separating device to differing strengths of materials or to accomodate pieces to be separated by changes of the operating penetration of pins 8 and 14.

At start of the process, the lifting element 1 is actuated, and the two-segmented connecting element 4 with both pin bars is lowered until pressure plate 18 rests upon the top part 20 of a staple cut part. Here this elevation is in the range of staple height plus separation height and a preferable pressure or time sequence of the lifting element compensates for differences of staple levels. The pressure plate 18 determines the limit of the elevation. The result is that even after repeated separation, the staple table does not have to be readjusted (not illustrated) and each piece to be separated is exposed to identical conditions (for instance, pressure upon its base). Pins 8 of the inner, immobile pin carriers 7 are so adjusted that they now only negligibly prick into the top piece 20 of the blank staple 21 through the slots 19 of the pressure plate 18, thereby securing the piece 20 in that location.

In contrast, pins 14 of the outer, mobile pin carrier 13 are adjusted so that they close in starting position with the lower edge of pressure plate 18.

Figure 4:
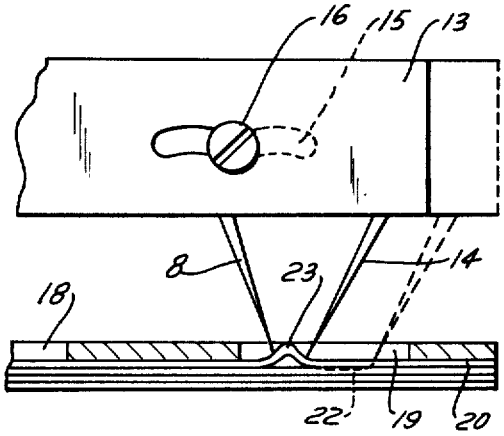
FIG. 4 is an enlarged partial cut out view of FIG. 2 representing the motion of the pin.

By actuating drive elements 10, the outer pin carriers 13 move in accordance with guidance of the curved groove of the longitudinal holes 15 wherby pins 14 drop lower and define a curve of movement according to FIG. 4. This curve reaches its lowest point when the vertex of the longitudinal hole is reached. Then, pins 14 grip the top piece 20 by slight penetration of its surface and effect formation of fold 23. When the outer pin carriers 13 move to the end of the longitudinal holes 15, the pins 14 are again lifted according to the motion curve 22, thereby reinforcing the creation of folds and the closest proximity of the points of pins 8 and 14 to each other.

Thereby, the top piece 20 is gathered in the area of creation of the fold and the area of material between individual folds 23 is stretched, causing the top piece 20 to move in these material areas relative to the surface of the remaining staple 21.

Then drive elements 1 and 5 are actuated and the device is again raised, causing a simultaneous increase of the distance between both pin bars by the elongation of connecting element 4. This causes tightening of piece 20 in a transversal direction. This resumed transversely directed relative movement now overcomes all adherent force which might still be present and acting upon the rest of the staple, and piece 20 is securely raised. It may now be brought to another processing position when so needed, where another actuation of drive elements 10 returns pins carriers 13 to their starting position, thereby releasing piece 20.

We claim:

1. A device for separating a stack of planar material, piece by piece, comprising
   - (A) an immobile pin carrier,
   - (B) a series of pins affixed to said immobile pin carrier (A) at discrete intervals,
   - (C) a guiding element affixed to said immobile pin carrier (A),
   - (D) a mobile pin carrier,
   - (E) a series of pins affixed to said mobile pin carrier (D) at discrete intervals, said pins pointing downwardly toward the pins (B) of said immobile pin carrier (A) in a lateral direction and bent at a greater angle than the series of pins (B) of the immobile pin carrier (A), said series of pins (B) and (E) of both the immobile and mobile pin carriers (A) and (D) disposed in a common longitudinal vertical plane, and
   - (F) a hole on said mobile pin carrier (D) engaged with the guiding element (C) on said immobile pin carrier (B), said hole in the shape of a convex curved groove, whereby the mobile pin carrier (D) moves downwardly in the direction defined by the hole (F) and the guiding element (C) so that pins (E) grip a top layer of the stack forming a fold between pins (B) and (E), and the mobile pin carrier (D), following the direction defined by the hole (F) around the guiding element (C), is raised to reinforce formation of the fold in the top layer of the stack of planar material.

2. The device of claim 1 additionally comprising
   - (G) a lifting element,
   - (H) a connecting element disposed underneath said lifting element, said connecting element comprising
   - (H)(1) and (H)(2) two segments in slidable relationship to one another,
   - (I) a driving element connected to said two slidable segments (H)(1) and (H)(2),
   - (J) an additional immobile pin carrier with both said immobile pin carriers (A) and (J) each being laterally connected to one of said slidable segments (H)(1) and (H)(2),
   - (K) an additional series of pins arranged at discrete intervals along the length of said additional immobile pin carrier (J), said additional series of pins (K) pointing downwardly at a slight angle of inclination,
   - (L) an additional guiding element affixed to said additional immobile pin carrier (J),
   - (M) an additional mobile pin carrier,
   - (N) two driving elements, one driving element connecting said immobile and mobile pin carriers (A) and (D), said other driving element connecting said additional immobile and mobile pin carriers (J) and (M),
   - (O) an additional series of pins arranged at discrete intervals along the length of said additional mobile pin carrier (M), said pins pointing downwardly toward the pins (K) of said additional immobile pin carrier (J) in a lateral direction and bent at a greater angle than the series of pins (K) of said additional immobile pin carrier (J), said series of pins (K) and (O) of both the additional immobile and mobile pin carriers (K) and (M) disposed in a common longitudinal vertical plane, and said pins (E) and (O) of said mobile pin carriers (D) and (M) pointing at a slight angle to form an acute angle with the series of pins (B) and (K) of the immobile pin carriers (A) and (J) in the lateral direction,
   - (P) a hole in said additional mobile pin carrier (M) in the shape of a convex curved groove and meshing with said additional guiding element (L) affixed to said additional immobile pin carrier (J), and
   - (Q) two pressure plates, each pressure plate underneath a respective immobile pin carrier (A) or (J), said pressure plates provided with slots into which pins (B), (E), (K), and (O) extend to contact a top layer of the stack of planar material.

3. The device of claim 2 additionally comprising
   - (R) a bridge for articulately fastening said connecting element (H) to said lifting element (G).

4. The device of claim 3 additionally comprising
   - (S) two slidable spacing pieces, each piece connecting a respective immobile pin carrier (A) or (J) to a respective pressure plate (Q).

5. The device of claim 4 in which the lifting element (G) rises to a height approximately corresponding to the sum of the height of the stack and the height necessary to separate the top layer of the stack.

* * * * *